United States Patent [19]

Yurtin et al.

[11] Patent Number: 4,746,306

[45] Date of Patent: May 24, 1988

[54] ELECTRICAL CONNECTOR LOCK WITH GAUGE PIN

[75] Inventors: John A. Yurtin, Southington; Robert G. Plyler, Vienna; Andrew M. Spisak, Youngstown, all of Ohio

[73] Assignee: General Motors Corporation, Detroit, Mich.

[21] Appl. No.: 362,495

[22] Filed: Mar. 26, 1982

[51] Int. Cl.[4] ..... H01R 13/627; H01R 13/639

[52] U.S. Cl. ..... 439/357; 439/352

[58] Field of Search ..... 339/91 R, 80, 82, DIG. 2; 439/301, 304, 350–358

[56] References Cited

U.S. PATENT DOCUMENTS

| | | | |
|---|---|---|---|
| 2,077,181 | 4/1937 | Morse | 173/338 |
| 2,128,513 | 8/1938 | Dotterer | 339/278 R |
| 3,662,320 | 5/1972 | Marx | 339/82 |
| 4,010,998 | 3/1977 | Tolnar, Jr. et al. | 339/91 R |
| 4,113,179 | 9/1978 | McKee | 339/91 R |
| 4,273,403 | 6/1981 | Cairns | 339/91 R |
| 4,302,066 | 11/1981 | Newman et al. | 339/82 |
| 4,370,013 | 1/1983 | Niitsu et al. | 339/91 R |

FOREIGN PATENT DOCUMENTS

| | | | |
|---|---|---|---|
| 353296 | 5/1920 | Fed. Rep. of Germany | 339/82 |

*Primary Examiner*—Gil Weidenfeld
*Assistant Examiner*—Gary F. Paumen
*Attorney, Agent, or Firm*—F. J. Fodale

[57] ABSTRACT

An electrical connector has dielectric connector bodies which are coupled and locked together by a resilient lock member of one connector body which snaps past and engages a lock member of the other connector body.

The resilient lock member includes a slot which extends through one end and a lock shoulder which faces the opposite end.

The other lock member includes a lock shoulder and a loop which passes through the slot of the resilient lock member and cooperatively forms a gauge hole of predetermined minimum size with the resilient lock member when the connector bodies are coupled and locked together by the lock shoulders. A gauge pin having a shank of substantially the same predetermined minimum size is disposed in the gauge hole to indicate that the connector bodies are locked together by the lock shoulders.

3 Claims, 2 Drawing Sheets

ELECTRICAL CONNECTOR LOCK WITH GAUGE PIN

This invention relates generally to electrical connectors and, more particularly, to electrical connectors having dielectric connector bodies which are coupled and locked together by a deflectable lock member of one connector which snaps past and engages a lock member of the other connector body.

An electrical connector of this general type is disclosed in U.S. Pat. No. 4,010,998 granted to Emil J. Tolnar, Robert D. Plyler and David R. Heilman on Mar. 8, 1977. This patent is directed to an "inertia" lock which is designed to assure that the electrical connectors are fully coupled and positively locked together by a manual assembly operation. The intertia lock avoids the problem of the electrical connectors being partially and frictionally coupled by manual assembly and then decoupled by vibration or some other environmental influence during subsequent use. However, the inertia lock requires high mating forces and special placement of the electric terminals in the connector bodies.

The object of this invention is to provide an improved lock which assures that the electrical connectors are fully coupled and positively locked together by a manual assembly operation and which avoids the drawbacks noted above. The improved lock is simple and efficient and takes the form of a gauge hole which is cooperatively formed by the connector bodies and a gauge pin which fits into the gauge hole when the electrical connectors are fully coupled and positively locked together.

The advantage of the lock of this invention in comparison to the "inertia" lock is that high mating forces and special placement of the electric terminals in the connector bodies are not required.

Another feature of the invention is that the gauge hole is cooperatively formed by the connector lock members themselves to minimize tolerance, stack-up variations and enhance the precision of the gauge hole.

Another feature of the invention is that the gauge pin is retained in the gauge hole to serve as a visual inspection device indicating that the connector bodies are properly coupled.

Another feature of the invention is that the gauge pin retains the lock members in a locked position and provides a second lock.

Yet another feature of the invention is that the connector bodies include structure to guard against jamming and locking the gauge pin into spaces other than the gauge hole.

Other objects and features of the invention will become apparent to those skilled in the art as the disclosure is made in the following detailed description of a preferred embodiment of the invention as illustrated in the accompanying sheets of drawing in which.

Figure 1:
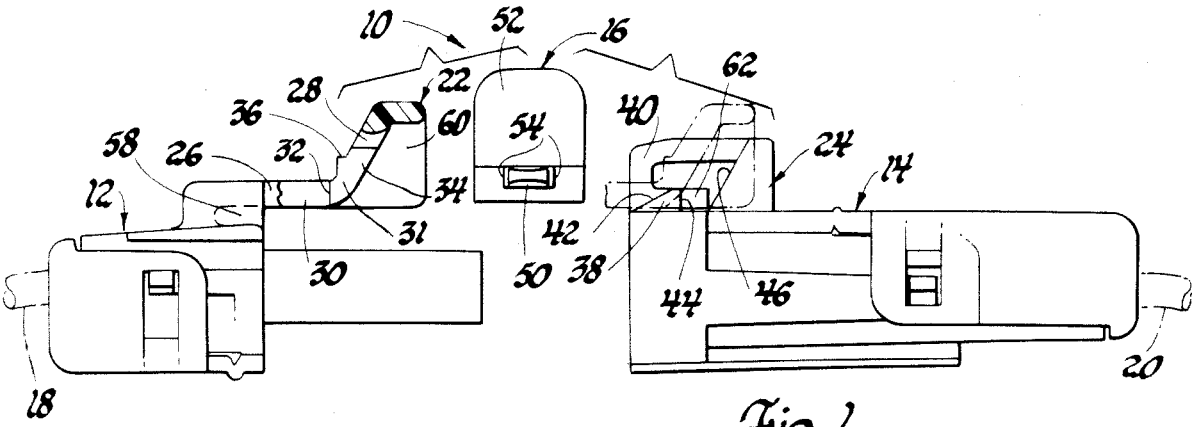
FIG. 1 is a side view of an electrical connector in accordance with this invention showing the electrical connector in a decoupled condition.

Referring now to the drawing, the electrical connector 10 comprises matable dielectric connector bodies 12 and 14 and a gauge pin 16.

Figure 2:
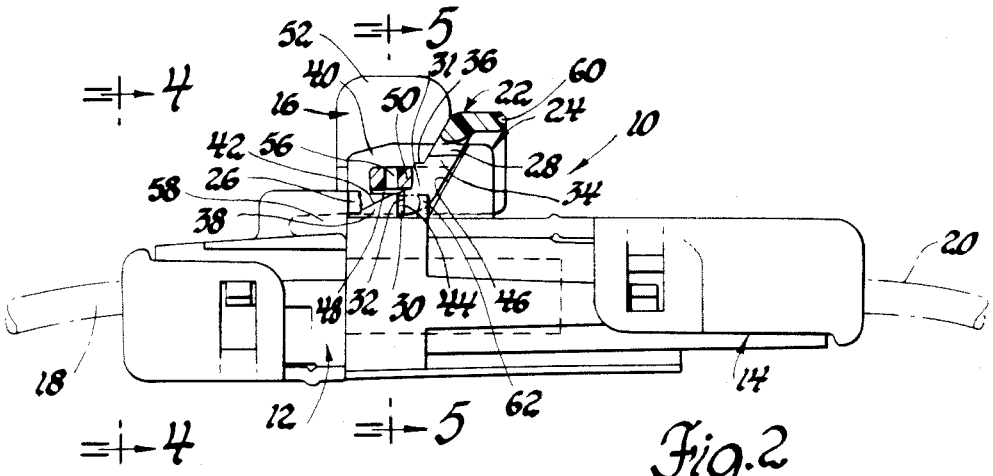
FIG. 2 is a side view showing the electrical connector of FIG. 1 in a coupled condition.
Figure 3:
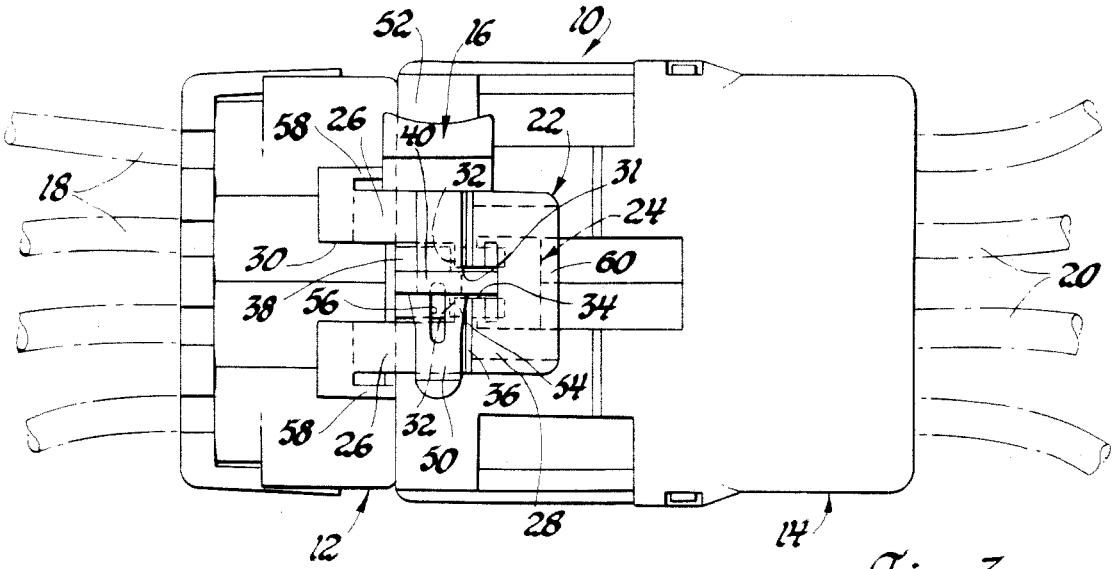
FIG. 3 is a top view of the coupled electrical connector shown in FIG. 2.
Figure 4:
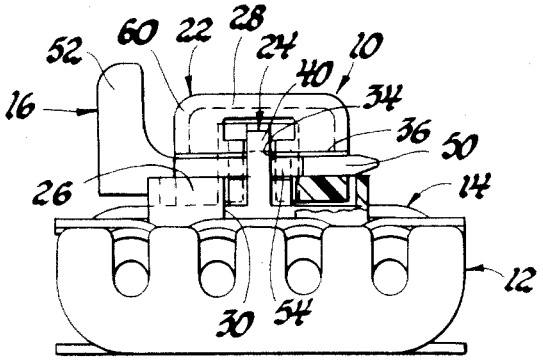
FIG. 4 is a front view taken substantially along the line 4—4 of FIG. 2 looking in the direction of the arrows.
Figure 5:
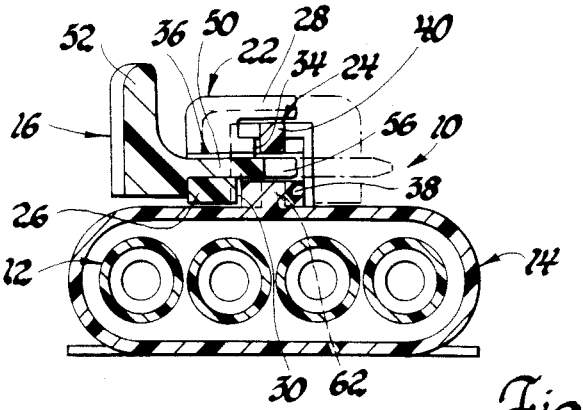
FIG. 5 is a view taken substantially along the line 5—5 of FIG. 2 looking in the direction of the arrows.
Figure 6:
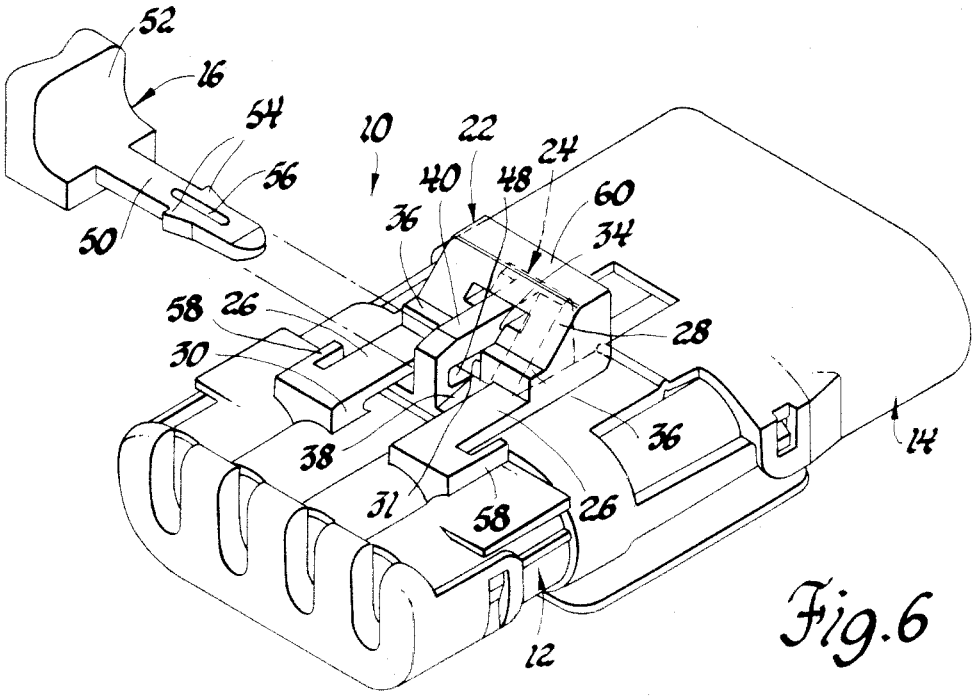
FIG. 6 is a perspective view of the coupled electrical connector showing the gauge pin in position for assembly.

The connector body 12 contains a plurality of electric terminals (not shown) which are attached to electric leads 18 and the connector body 14 contains also a plurality of electric terminals (not shown) attached to the electric leads 20. The terminals are of any type which mate when the connector bodies 12 and 14 are coupled as shown in FIG. 2 thru 6.

When coupled, the connector bodies 12 and 14 are locked together by cooperating lock members 22 and 24 of the respective connector bodies 12 and 14.

The lock member 22 of the connector body 12 comprises a deflectable latch arm 26 which is attached at one end to the connector body 12 and extends in cantilever fashion toward the forward mating end of the connector body 12.

The lock member 22 further comprises an outwardly and forwardly sloped tab 28 at the free end of the latch arm 26.

The latch arm 26 has a central slot 30 which extends through the free end where the tab 28 is integrally attached. The locking portion of the lock member 22 is preferably as close to the connector body 12 as possible. Consequently, the central slot 30 has a narrow portion 31 at the free end to provide two inner lock shoulders 32 in the plane of the latch arm 26.

The tab 28 also has a narrow slot 34 which extends from the narrow portion 31 of the central slot 30 part way up the tab 28. The obtuse angle between latch arm 26 and the tab 28 is squared up by triangular corner pieces 36.

The cooperating lock member 24 of the connector body 14 comprises a triangular lock projection 38 at the forward or mating end of the connector body 14 and a loop 40. The lock projection 38 has a forward cam surface 42 for engaging the tab 28 and deflecting the latch arm 26 outwardly during coupling and a rearward latch shoulder 44 which engages the lock shoulders 32 when the latch arm 26 snaps back.

The loop 40 is attached at one end to the lock projection 38 and extends outwardly thereof. The other end of the loop 40 is attached to the connector body 14 rearwardly of the lock projection 38.

The forward portion of the loop 40 is narrower than the lock projection and it slides through the narrow slot 34 of the tab 28 and the narrow portion 31 of the slot 30 of the latch arm 26 when the connector bodies 12 and 14 are coupled. The rearward portion of the loop 40 is wide and has a rearwardly and outwardly sloping abutment 46 which engages the tab 28 to stop the coupling movement.

When the connector bodies 12 and 14 are fully mated and locked together, the lock members 22 and 24 cooperatively form a rectangular gauge hole 48 as shown in FIGS. 2 thru 6. The gauge hole 48 has a predetermined minimum size when the connector bodies 12 and 14 are properly coupled, that is, fully mated and locked together by the lock shoulders 32 and 44.

The gauge pin 16 assures that the connector bodies 12 and 14 are properly coupled. It comprises a rectangular shank 50 and an enlarged head 52 shaped as a finger grip. The rectangular shank 50 is sized so that it fits into the gauge hole 48 when the connector bodies 12 and 14 are properly coupled but does not fit when the connector bodies 12 and 14 are not properly coupled.

When the shank 50 is inserted in the gauge hole 48, the gauge pin 16 is retained in assembly with the lock members 22 and 24 by the head 52 and tangs 54 from a portion of the shank 50 which is flexible by virtue of the elongated slot 56. When retained, the gauge pin 16 serves as a visual inspection device indicating that the connector bodies 12 and 14 are properly coupled. Consequently, the gauge pin 16 should be of a highly visible color in comparison to the connector bodies 12 and 14, for instance a yellow gauge pin used with grey connector bodies.

The gauge pin 16 also holds the latch arm 26 down in a locked position where the lock shoulders 32 and 44 prevent decoupling of the connector bodies 12 and 14. In addition, the gauge pin 16 prevents withdrawal of the loop 40 and thus provides a second lock.

The connector bodies 12 and 14 also include structure to guard against the gauge pin 16 being jammed and locked into spaces other than the gauge hole 48. Specifically, the connector body 12 has integral wings 58 spaced from the latch arm 26 at the attachment end. These wings prevent inserting and frictionally locking the gauge pin shank 50 in the space between the latch arm 26 and the connector body 12 near the attachment end of the latch arm 26. The sloped tab 28 at the free end of the latch arm 26 also has a forwardly projecting U-shaped flange 60 which prevents a forced insertion of the shank 50 into the space between the sloped tab 28 and the abutment 46 of the coupled connector bodies. The connector body 14 also has a narrow rib 62 behind the lock projection 38 to prevent a forced insertion of the shank 50 into the space behind the latch shoulder 44 between the latch arm 26 and the connector body 14.

We wish it to be understood that we do not desire to be limited to the exact details of construction shown and described for obvious modifications will occur to a person skilled in the art.

The embodiments of the invention in which an exclusive property or privilege is claimed are defined as follows:

1. In an electrical connector having dielectric conenctor bodies which are coupled and locked together by a deflectable lock member of one connector body which snaps past and engages a rigid lock member of the other connector body, the combination comprising:

said deflectable lock member including a cantilevered arm having a slot which extends through a fire end of the cantilevered arm and a lock shoulder which is in the slot and faces toward an opposite end of the cantilevered arm, said rigid lock member including a loop which has one end insertable into the slot of the cantilevered arm and a lock shoulder which faces an opposite end of the loop, said loop having a portion disposed in the slot of the cantilevered arm and cooperatively forming a gauge hole of predetermined minimum size with the deflectable lock member when the connector bodies are coupled and locked together by the lock shoulders, and a gauge pin having a shank of substantially the same predetermined minimum size disposed in the gauge hole, to indicate that the connector bodies are locked together by the lock shoulders and to prevent deflection of the deflectable lock member and consequent disengagement of the lock shoulders.

2. In an electrical connector having dielectric connector bodies which are coupled and locked together by a deflectable lock member of one connector body which snaps past and engages a rigid lock member of the other connector body, the combination comprising:

said deflectable lock member including a cantilevered latch arm and a sloping tab at a free end of the cantilevered latch arm, said latch arm having a slot which extends through the free end of the latch arm and which has a narrow portion extending from the free end to provide a lock shoulder which is in the plane of the latch arm, said tab having a slot which communicates with the narrow portion of the slot in the latch arm, said rigid lock member including a lock projection and a loop which extends outwardly of the lock projection, said loop having a narrow end portion which is insertable into the narrow portion of the slot in the arm and the slot in the tab and a wide end portion which provides an abutment for the tab of the cantilevered arm and a lock shoulder which faces an opposite end of the lock member, said lock projection having a lock shoulder which faces the wide portion of the loop, said narrow end portion of the loop passing through the slots of the arm and the tab and cooperatively forming a gauge hole of predertermined minimum size with the resilient lock member when the connector bodies are coupled and locked together by the lock shoulders, a gauge pin having a shank of substantially the same predetermined minimum size disposed in the gauge hole to indicate that the connector bodies are locked together by the lock shoulders, and said gauge pin having means for retaining the shank in the gauge hole.

3. In an electrical connector having dielectric connector bodies which are coupled and locked together by a deflectable lock member of one connecotr body which snaps past and engages a rigid lock member of the other connector body, the combination comprising:

said deflectable lock member including a cantilevered latch arm and a sloping tab at a free end of the cantilevered latch arm, said latch arm having a slot which extends through the free end of the latch arm and which has a narrow portion extending from the free end to provide a lock shoulder which is in the plane of the latch arm, said tab having a slot which communicates with the narrow portion extending of the slot in the latch arm, said rigid lock member including a lock projection and a loop which extends outwardly of the lock projection, said loop having a narrow end portion which is insertable into the narrow portion of the slot in the arm and the slot in the tab and a wide end portion which provides an abutment for the tab of the cantilevered arm and a lock shoulder which faces an opposite end of the lock member, said lock projection having a lock shoulder which faces the wide portion of the loop, said narrow end portion of the loop passing through the slots of the arm and the tab and cooperatively forming a gauge hole of predetermined minimum size with the resilient lock member when the connector bodies are coupled and locked together by the lock shoulders, a gauge pin haivng a shank of substantially the same predetermined minimum size disposed in the gauge hole to indicate that the connector bodies are locked together by the lock shoulders, and means for guarding against jamming and locking the shank in spaces other than the gauge hole, said means comprising integral wings spaced from the cantilevered latch arm near its attachment end, a forwardly projecting, U-shaped flange on the sloping tab, and an integral narrow rib behind the lock projection.

* * * * *